US005557904A

United States Patent [19]

Dahowski

[11] Patent Number: 5,557,904

[45] Date of Patent: Sep. 24, 1996

[54] THERMOFORMABLE PLASTIC FRAMIN/CONNECTING STRIP

[75] Inventor: Donald E. Dahowski, York, Pa.

[73] Assignee: Quaker Plastic Corporation, Mountville, Pa.

[21] Appl. No.: 452,571

[22] Filed: May 25, 1995

Related U.S. Application Data

[63] Continuation-in-part of Ser. No. 969,132, Oct. 30, 1992, abandoned.

[51] Int. Cl.[6] ..... H04C 2/00

[52] U.S. Cl. ..... 52/631; 52/741.2; 52/717.05; 264/154; 264/322

[58] Field of Search ..... 52/631, 658, 475, 52/476, 656.1, 169.7, 656.2, 656.6, 742.5; 160/381; 29/897, 897.31, 897.32; 264/154, 322

[56] References Cited

U.S. PATENT DOCUMENTS

| | | | |
|---|---|---|---|
| 282,136 | 8/1883 | Mosler | 29/897 |
| 2,002,044 | 5/1935 | Rothenstein | 29/897.31 |
| 2,388,297 | 11/1945 | Slaughter | 52/282 |
| 2,776,793 | 1/1957 | Nystrom . | |
| 3,287,041 | 11/1966 | Cohen | 52/658 |
| 3,315,431 | 4/1967 | Yake | 52/475 |
| 3,376,670 | 4/1968 | Jones | 52/656.6 |
| 4,589,237 | 5/1986 | Dahowski | 52/169.7 |
| 4,738,069 | 4/1988 | Williams | 52/652 |
| 5,052,913 | 10/1991 | Conliffe | 264/339 |
| 5,067,228 | 11/1991 | Gardenier | 52/169.7 |
| 5,098,632 | 3/1992 | Conliffe | 264/339 |
| 5,152,119 | 10/1992 | Miller | 52/631 |

*Primary Examiner*—Darnell M. Boucher
*Attorney, Agent, or Firm*—Arthur J. Plantamura

[57] ABSTRACT

A face plate or framing member is thermoformed from a continuous length of longitudinal member which has a substantially flat cross section. The member is notched at predetermined locations along its length where the corners of the thermoformed face plate are situated. An enlarged opening at the apex of the notches facilitates and enhances the bending and corner forming of the longitudinal member as the member is bent along its longitudinal axis and along the the substantially flat of the member while maintaining the continuity of the longitudinal member. The thermoformed article prepared is of particular utility as a face plate or frame and may be used to cover and seal the connection such as that between a wall opening and a pre-formed stair module positioned in the wall opening of an inground swimming pool.

4 Claims, 1 Drawing Sheet

THERMOFORMABLE PLASTIC FRAMIN/CONNECTING STRIP

This is a continuation-in-part of application of prior application Ser. No. 07/969,132 filed on Oct. 30, 1992, abandoned.

This invention relates to a method of thermoforming a plastic linear member having a cross section which is substantially flat. When formed the member may be employed as a face plate or framing contiguous to an opening such as a door or window or on a swimming pool wall contigous to the swimming pool stairwell opening. In particular, the invention relates to a novel method for bending the longitudinal member into a desired shape while maintaining the continuity of the member during and after its shaping. The the longitudinal element which has a substantially flat cross section is bent under heat along its longitudinal axis and in the plane of the strip, to provide the desired shape. The invention relates also to the product produced thereby.

BACKGROUND OF THE INVENTION

The present invention provides an improvement in the provision of structural connecting element of a conventional cross sectional configuration that are available in lumber supply outlets of the kind that are generally used to frame door or window openings. The longitudinal forming elements of the invention are those of thermoplastic composition variety which lend themselves to thermoforming. The thermoformed shapes produced according to the invention, while not limited thereto, has particularly advantageous application in the securing of a preformed stair module in in a swimming pool wall opening and to the swimming pool wall. The thermoformed framing or face plate of the invention functions also to secure a swimming pool vinyl liner on the pool wall at the edges of the stairwell opening. Such vinyl liners are conventional in pools of this kind and are use to cover the pool wall and bottom and extend to peripheral edge of the stair module. The framing/connecting member which is thermoformed according to the invention is employed in combination with a gasket arrangement to secure against the leakage of water at the juncture of the stair module and the pool wall and comprises the exposed face plate bordering the stairwell opening.

Heretofore, stair mount connecting/framing or facing elements have generally been formed of separate pieces that are butted or mitered to the desired angle to accommodate the shape of the opening at which the face plate or frame is to be applied. Such prior art arrangements have been unsatisfactory aesthetically as well as functionally because of the difficulty of providing a smooth joint at the corners of the components forming the face plate or frame. Additionally, a proper fitting and securing of conventional multiple parts that are mitered or butted to provide the frame or face plate have been time consuming and difficult. Because of the relatively sharp corners resulting from an assembly of multiple piece frames, such have been the cause of snagging and tearing of vinyl swimming pool liners.

Accordingly, a need exists for the provision of an improved joinder arrangement in lieu of a structure formed from abutting a plurality of pieces to form the face plate or framing element. More particularly, a need exist for a means to provide a swimming pool wall opening with a unitary (continuous) framing member which provides a face plate and frames and covers the peripheral edge of a preformed stair module that has been fitted into the wall opening of an inground swimming pool.

SUMMARY OF THE INVENTION

It is an object of the invention to provide a novel method for shaping a unitary thermoformed framing/connecting member. Such member being of especial value as a face plate and is an important component in securing and sealing the joint where the periphery of a stairwell module is connected in the stairwell opening in a swimming pool wall.

It is a more specific object of the invention to provide a means for heating and bending into the desired framing shape a unitary longitudinal framing member or thermoformable strip to form a facing member which eliminates the often uneven unsightly corners that result when separate pieces are butted to form a face plate.

It is a further object of the invention to provide a more aesthetically pleasing corner radius for the corners of framing member or face plate and to minimize the possibility of tears in swimming pool vinyl liners which can result from the relatively sharp corners obtained when connecting or joining from a plurality of pieces the desired framing or face plate.

It is still a further object of the invention to provide a novel thermoformed unitary face plate or frame obtained by bending a length of longitudinal facing strip that has a conventionally shaped substantially flat or contoured cross section along its longitudinal axis and in the plane of the strip while maintaining the continuity of the strip.

Additional objects and advantages of the invention will become apparent from the accompanying drawing and description which follows.

DETAILED DESCRIPTION OF THE INVENTION

Figure 1:
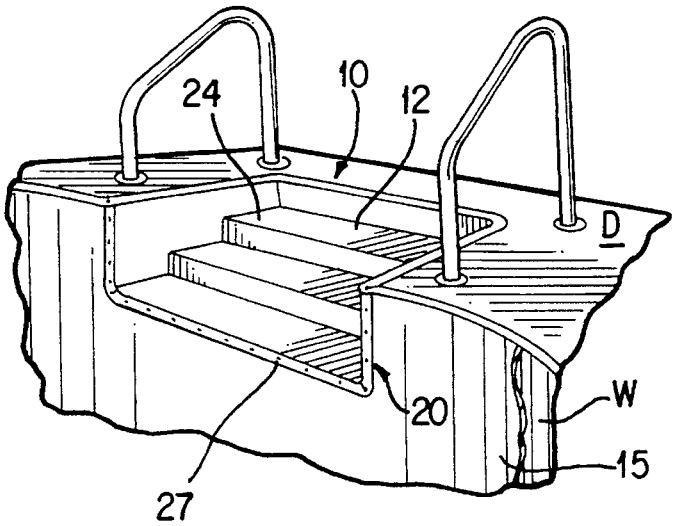
FIG. 1 is a perspective view of a typical molded plastic swimming pool stair module shown in relationship to a contiguous in-ground swimming pool wall and deck, a fragment only of which is shown, and illustrates the thermoformed face plate 20 secured to the vertical wall of the swimming pool at the point on the wall where the the periphery of the stair well module is fastened.

Referring more particularly to the figures of the drawing, a preformed plastic modular stair unit generally indicated at 10 is shown in FIG. 1 in position relative to an in-ground swimming pool, a fragment only of the wall W and deck D of the pool being illustrated.

The modular stair shell 12 is shown in place in an opening in the vertical pool wall W which is normally substantially below ground level. The stair module 12 is suitable supported at its underside such as by the arrangement described in my U.S. Pat. No. 4,873,802.

In general, a swimming pool wall W of the kind with which the invention is advantageously used, comprises a plurality of steel panels which are joined end-to-end below ground level to comprise the periphery of the swimming pool enclosure. A horizontal deck D is provided at the top and around ther periphery of the wall W. A water impermeable vinyl liner 15 covers the walls and floor of the swimming pool. Suitable openings are formed in the swimming pool wall to accommodate various accessories, including, most significantly, a preformed molded plastic stair module, one embodiment of which is illustrated in FIG. 1.

The face plate or framing transition element 20 formed in accordance with the invention is employed to cover the edges of the stair module. This face plate 20 presents an attractive and has, as well, the functional purpose of covering the joint between the stair module edges and the wall opening edges. Additionally the face plate 20 seals the edge of the vinyl liner 15 at the joinder point of the wall and the stair module presenting an aesthetically pleasing appearance. The face plate 20 is preferably employed in connection with suitable gasketing (not shown) interposed at the joint behind the face plate 20 to enhance the seal at the joint.

Figure 2:
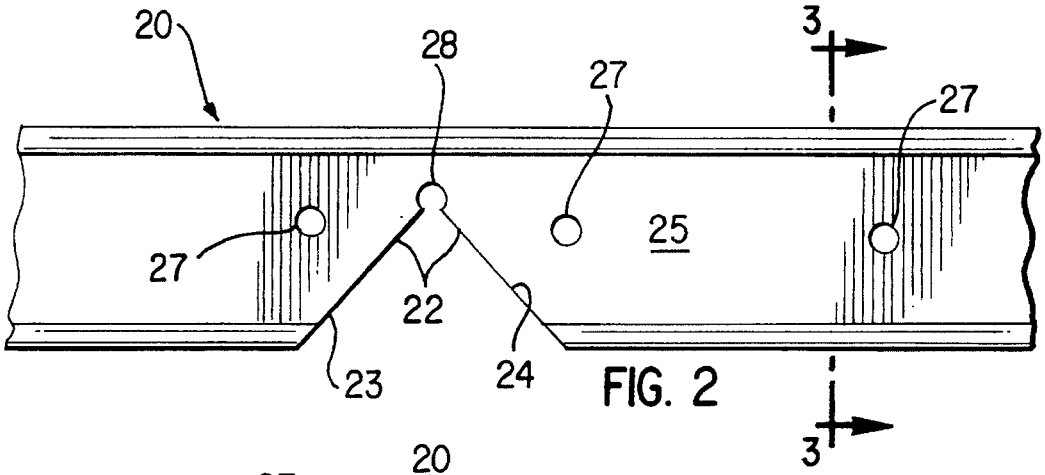
FIG. 2 illustrates the facing side of a segment of a preferred form of a substantially flat longitudinal thermoplastic member before it is thermoformed, according the the invention—showing cut-outs that permit the thermal shaping to the desired configuration of the member—to provide a unitary frame or face plate while maintaing the continuity of the strip as a single piece.
Figure 4:
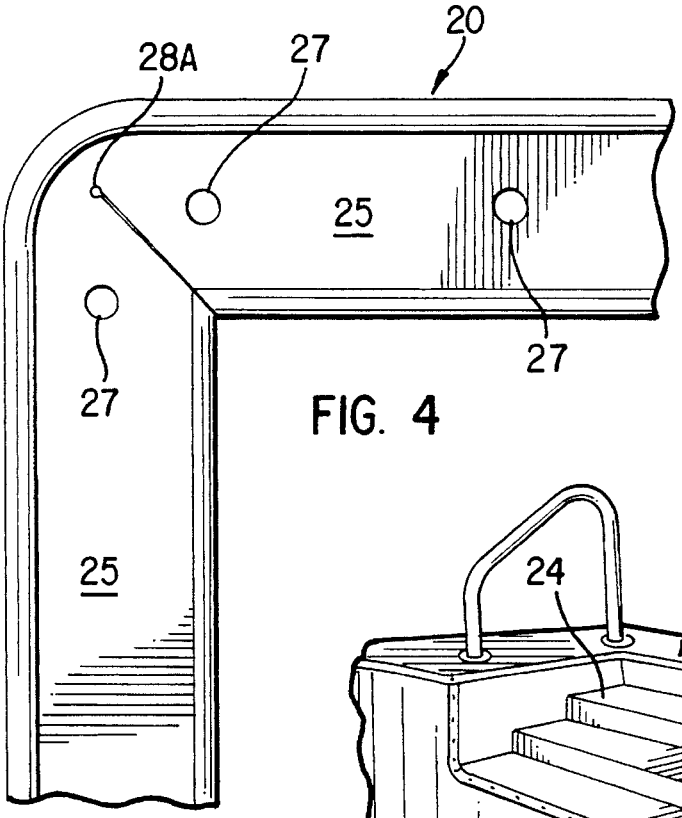
FIG. 4 is a fragmentary illustration of a longitudinal framing or face member of the kind illustrated in FIG. 2, which has been thermoformed, to produce at the point of the cut out, a corner configuration for the formed face plate while maintaining the continuity (through the formed corners) of the bent member.

Referring to FIG. 2 of the drawing, a segment (before thermoforming) of the longitudinal facing member 20 that has a substantially flat cross section is illustrated in which a notch comprising the sides 22 is suitably formed to permit the thermoforming of the strip to produce the desired face plate shape for the designated opening. The notch shown at 22 in FIG. 2 is formed preparatory to the bending of the longitudinal member (under heat) along the longitudinal axis and in the plane of the member while maintaining the continuity of the member through the corners of the finished face plate that is formed from the longitudinal member. It will be apparent that the thermoform bending at the notch locations is effected in the plane which passes through the center of the said substantially flat cross section of the longitudinal member. In the embodiment illustrated in FIGS. 2 and 4, a cut out 22 is provided to form a 90 degree angle corner. For this purpose, two cuts 23 and 24 at an angle of 45 degrees relative to the longitudinal axis of the facing or framing member are made in the member 20 such that, upon bending under heat, a corner having the desired angle results. In the embodiment illustrated in which the 45 degree complementary cuts 23 and 24 are made, a face plate having a 90 degree angle corner is produced.

I have discovered, in accordance with the invention, that when the cuts shown at 23 and 24 are formed so as to culminate in a sharp point—rather than as in accordance with the invention of providing an enlarged opening at the apex—upon bending under heat and pressure, the plastic composition at the apex is forced outward and protrudes above the surface plane of the strip producing an aesthetically undesirable effect at the apex. This protrusion from the squeezing out of molten plastic generally forms to a relatively sharp point which causes snags and tears of materials, such as a vinyl swimming pool liner, and at times even causes injury.

To avoid this undesirable effect and to facilitate the bending, i.e., shaping, function and produce a smoother and more aesthetically presentable planar surface prior to thermoforming the face plate, I provide a relative enlarged opening at the apex of the V-cut, such as the "keyhole" shown at 28 in FIG. 2. The effect of the opening at the apex produces an improved result. I have discovered that upon thermoforming the strip with the enlarged opening 28 present at the apex of the V-cut in the strip, the plastic material, which would otherwise tend to be forced outward of the surface of the strip 25 at the apex point 28, is contained within this enlarged opening 28. Additionally, I have found that the opening 28, during the heating and compressing a plastic material at the apex, is neatly and substantially uniformly closed as shown at 28A in FIG. 4 by the displaced plastic as the corner of the strip 20 is being formed. Moreover, it appears that the actual bending of the strip, when an enlarged opening is present at the apex, is generally facilitated.

In the embodiment shown in FIG. 2, the opening 28 is conveniently formed by drilling a hole at the apex. The opening 28 is preferably sized so as to be substantially filled when the longitudinal facing member 20 is heated and bent to form a corner such as that illustrated in FIG. 4. For example, with a facing member 20 having a width of about 1.5 inches, a hole 28 having a diameter of about 0.10 to about 0.30 inches, is generally adequate.

Figure 3:
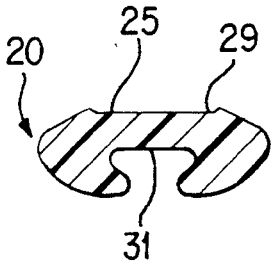
FIG. 3 is a cross sectional view, taken along line 3—3 of FIG. 2, of the substantially flat strip or face plate member.

Also illustrated at 27 in the thermoformable member 20 are a plurality of holes for fastening screws to hold the thermoformed face plate 20 in place at the swimming pool wall/stairwell edge connection. The thermoformable member 20 may comprise any suitable configuration and is optionally but preferably provided with a suitable underside cut-out 31 (FIG. 3), adapted to better receive in the cut-out 31 a butted connection, such as the underlying joint between the peripheral edge of the stair module and the edge of the swimming pool wall opening which, as noted hereinabove, may include a vinyl water impermeable liner 15. Optionally, the surface 25 of the face plate member 20 may comprise an embossed or otherwise decorated configuration 29 (FIG. 3) to enhance the appearance of the framing connecting facing member 20.

It will be apparent that the angle of the cuts 23 and 24, with respect to the axis of the linear facing member will depend on the desired corner angle. Accordingly, when a 90 degree angle is desired, the cuts 23 and 24 will be formed at a 45 degree angle which will provide a conventional four-sided rectangle frame. Where a six-sided configuration is desired, the angle of the cuts, i.e., the wedge portion cutout, would be more acute. Hence, a cut-out segment which totals 60 degrees rather than 90 degrees angles as in FIG. 2 would provide an angle in the facing member of 120 degrees rather than the 90 degree corner of FIG. 4.

Although the invention has been described and illustrated in its preferred embodiment, it will be understood that the invention is not to be limited to the precise details illustrated and described since various modifications which fall within the scope of the invention as claimed hereafter will be apparent to one skilled in the art.

What is claimed is:

1. A method of forming a corner in a thermoformable longitudinal facing member having a contoured cross-section while maintaining the continuity of the member as the member is being formed comprising:

making a pair of converging cuts partially through and at predetermined space locations in said longitudinal member and at an angle transverse to the axis of the member and removing the essentially wedge-shape portion defined by said cuts, said angle corresponding to one half the angle of the bent angle of the member;

drilling an enlarged circular opening in the strip at the apex of the converting cuts;

heating the longitudinal member; and bending the said member along its longitudinal axis and in the plane of the longitudinal member thereby closing the opening and butting the edges of said converging cuts to define the desired corner.

2. The method of claim 1 wherein the cuts made in the longitudinal facing member are at an angle of 45 degrees to the axis of the member.

3. A method of making a face plate for affixing to and sealing the joint of a preformed stair module that is positioned in an opening in the wall of an inground swimming pool which comprises:

measuring the length of a longitudinal facing member which has a contoured cross section to a length commensurate with the total length of the peripheral edge of the stair module which abuts the swimming pool wall;

cutting a plurality of paired converging cuts partially through and transverse to the axis of the longitudinal member to form, at predetermined locations, spaced notches along the length of the member;

providing an enlarged opening at the top of said notches;

heating the longitudinal member;

bending the member along its longitudinal axis and in the plane of the member to close said notches and defining the desired corners while maintaining the continuity of the longitudinal member; and securing the thus formed face plate on a joint connecting the stair module periphery with the edge of a swimming pool wall opening.

4. The method of claim 3 wherein the longitudinal facing member is provided with a plurality of fastening screw holes along the length and through the surface of the member.

* * * * *